United States Patent [19]

Dixon

[11] 4,445,803

[45] May 1, 1984

[54] RESILIENT MARKER

[76] Inventor: Byron P. Dixon, 4138 S. 570 East #25C, Salt Lake City, Utah 84107

[21] Appl. No.: 450,653

[22] Filed: Dec. 17, 1982

[51] Int. Cl.[3] ..... E01F 9/00

[52] U.S. Cl. ..... 404/10; 404/16

[58] Field of Search ..... 404/10, 11, 16, 15, 404/12, 13, 14, 9; 350/107, 97; 116/63 R; 40/612

[56] References Cited

U.S. PATENT DOCUMENTS

| | | | |
|---|---|---|---|
| 1,833,124 | 11/1931 | Rand | 404/10 |
| 3,503,361 | 3/1970 | Icke | 116/63 R |
| 4,364,634 | 12/1982 | Björlund | 350/97 |

FOREIGN PATENT DOCUMENTS

| | | | |
|---|---|---|---|
| 1251788 | 10/1967 | Fed. Rep. of Germany | 404/16 |
| 1235337 | 5/1960 | France | 116/63 R |
| 1372878 | 11/1974 | United Kingdom | 404/10 |

*Primary Examiner*—William F. Pate, III
*Assistant Examiner*—Beverly E. Hjorth
*Attorney, Agent, or Firm*—B. Deon Criddle

[57] ABSTRACT

An economical reflective roadway marker having a substantially vertically disposed reflective assembly, a series of cantilevered protective flaps arranged to flex and cover reflective surfaces and an end base plate assembly by which the marker is attached to a road surface.

3 Claims, 4 Drawing Figures

RESILIENT MARKER

BACKGROUND OF INVENTION

1. Field of the Invention

This invention relates to reflective highway markers suitable for assisting drivers at night and during storms and is particularly concerned with such markers that are adaptable for use in climates necessitating snow removal operations whereby the markers are continuously subjected to being dislodged or destroyed.

2. Prior Art

As is generally known, reflecting markers have long been used as a means of delineating the traffic lanes of a highway. The marker devices often employ reflectorized tape or a special reflecting assembly and where snowplow operation is necessary a special means for guiding a snowplow blade up over the marker and/or for rigidly attaching the marker to the road surface to prevent the marker from dislodging as a snowplow blade passes over it. Representative devices are those disclosed in U.S. Pat. Nos.: 3,396,639; 3,587,416; 4,035,059 showing the use of reflectorized tape; and 3,924,958 showing a resiliently depressible assembly.

OBJECTS OF THE INVENTION

A principal object of the present invention is to provide a low-cost but durable reflective highway marker that is economical to use and replace.

A further object of the present invention is to provide an economical reflective highway marker that is readily useable in climates requiring snow removal and that will not be damaged by snow removal equipment.

Still another object of the present invention is to provide a reflective highway marker wherein the reflective surfaces are separately protected from damage due to tires and the like passing over them.

Yet another object is to provide a marker suitable for use on highways to delineate traffic lanes but also suitable for use on bridges, abutments, traffic islands, posts and other structures as warning devices.

PRINCIPAL FEATURES OF THE INVENTION

Principal features of the present invention include a base plate for attaching the marker to the road surface and a reflective assembly mounted to the base in such a manner as to be vertically disposed when the marker is attached to the road surface.

The reflective assembly is comprised of a series of transverse reflective surfaces separated by cantilevered flaps of resilient material mounted to extend transversely across the assembly at right angles to the reflective surfaces. In the preferred embodiment, as will be seen from the following detailed description, the reflective assembly is comprised of backing plate of resilient material on which is mounted reflective tape.

The cantilevered flaps are mounted on the backing plate and will flex to closely overlie and protect the reflective tape.

Other objects and features of the invention will become apparent from the following detailed description taken together with the accompanying drawings.

THE DRAWINGS

FIG. 1, is a perspective view of the present invention; and

FIG. 2, a side elevation view of the present invention with the reflective top assembly deflected over the base plate;

FIG. 3, a side elevation view of the marker of the invention with the top assembly deflected to be flat with the base plate and one set of flaps protecting the reflective strips.

FIG. 4, a view of like that of FIG. 3 but showing a different set of flaps protecting the reflective strips.

DETAILED DESCRIPTION OF THE DRAWINGS

Figure 1:
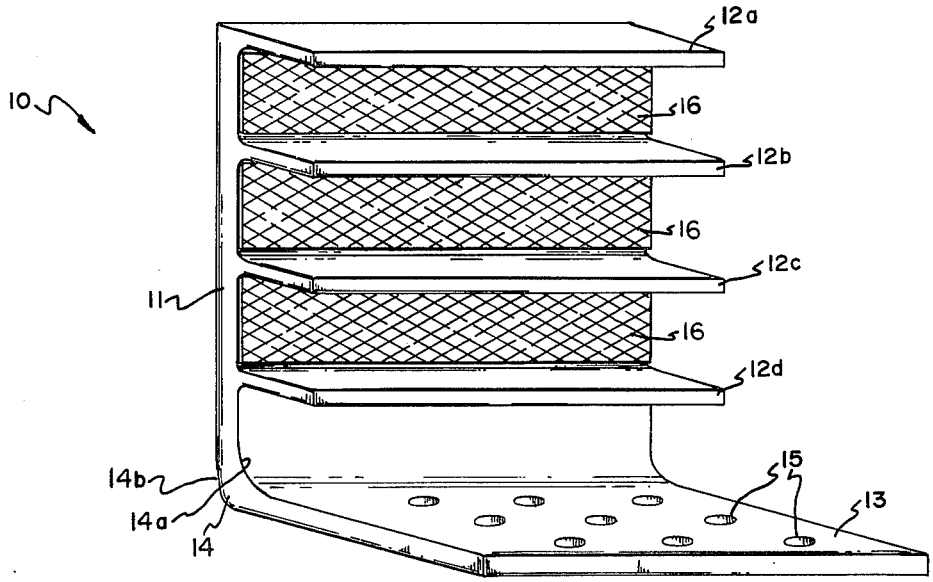
Figure 2:
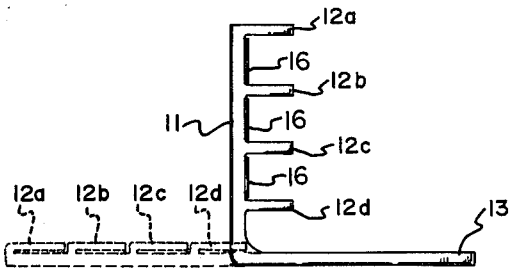

Referring now to the drawings:

In the illustrated preferred embodiment, the reflective highway marker of the invention is shown generally at 10 in FIGS. 1 and 2. The marker 10 has a top or reflective assembly 11 to which flaps **12*a*–12*d* are cantilever mounted. Base plate 13 is integarally connected by a curved section 14 of resilient material to the top assembly 11 and curved section 14 may have thickness greater than either the base plate 13 or top assembly 11. Preferably, the rate of curvature of the inner surface 14*a* of curved section 14 differs from that of the outer surface 14*b*. The inner surface is formed as a smooth arc whereas the outer surface has a more nearly right angle configuration. This preferred shape, in combination with the resilient nature of the material used in construction, insures return of the top assembly 11** to an upright position after being deformed under the load of a vehicle tire.

The marker 10 is attached to a road surface or other object to be marked by a mastic material applied to the object and forced through holes 15 in the base plate 13 to provide a secure bond. Strips of reflective material 16 are adhesively attached to the top assembly 11 between the protective flaps 12.

When the marker 10 is depressed under the weight of, for example, a rolling vehicle tire 17, see FIG. 2, protective flaps 12 bend to overlie reflective strips 14 and protect the strips 16 from abrasion and other general mechanical damage that could otherwise result.

Figure 3:
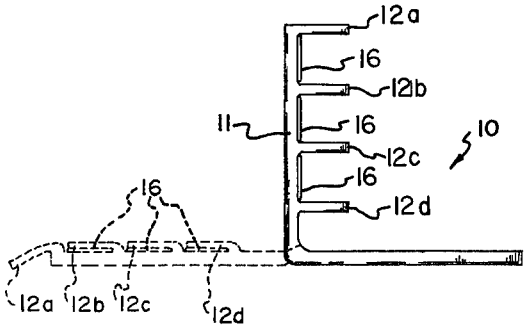
Figure 4:
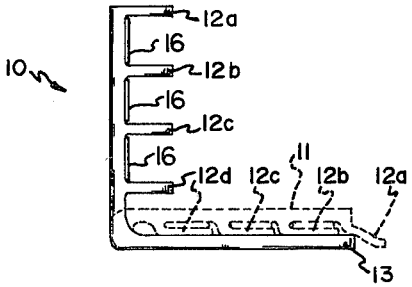

As shown in FIGS. 2–4, the reflective strips 16 are protected regardless of the manner in which the top assembly 11 is deflected and a load is applied thereto. If the top assembly is deflected to overlie the base plate the flaps **12*c*–12*d* will overlie strips 16 positioned between adjacent flaps as shown best in FIG. 3. If, the top assembly is deflected to lie in substantially the plane of the base plate 13 other flaps 12*a*–12*c* will be deflected over the strips 16 (FIG. 2) or the flaps 12*b*–12*d* will be so deflected (FIG. 3**) depending on the manner in which the load is applied to the flaps.

While not shown, it should be apparent that reflective strips may be applied to both faces of the top assembly and that protective strips can be cantilevered from both faces to protect the reflective strips if a marker visible from two sides is desired. Also, pairs of markers can be used in back-to-back relationships to provide a composite marker visible from opposite directions.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A reflective marker for delineating traffic control on a roadway and the like, said marker comprising:

a top assembly of resilient material having a pair of faces a plurality of spaced apart protective flaps attached to said top assembly and cantilevered from at least one face thereof;

a plurality of reflective surfaces on each face of the top assembly having said protective flaps extending therefrom and adjacent to said protective flaps;

a base plate for attaching said marker to a road surface or the like, said base plate being integrally formed with the top assembly and extending substantially normal thereto.

2. A reflective highway marker as in claim 1 wherein the plurality of reflective surfaces are each a rectangularly shaped strip of reflective material.

3. A reflective highway marker as in claim 1 wherein the flaps are each resilient and are deformable through an angle of approximately 90° with respect to a plane defined by the exterior surface of said top assembly.

* * * * *